US011365544B2

(12) United States Patent
Kurath-Grollman

(10) Patent No.: US 11,365,544 B2
(45) Date of Patent: Jun. 21, 2022

(54) REINFORCING ELEMENT FOR PRODUCING PRESTRESSED CONCRETE COMPONENTS, CONCRETE COMPONENT AND PRODUCTION METHODS

(71) Applicant: CPC AG, Andelfingen (CH)

(72) Inventor: Josef Peter Kurath-Grollman, Winterthur (CH)

(73) Assignee: CPC AG, Andelfingen (CH)

( * ) Notice: Subject to any disclaimer, the term of this patent is extended or adjusted under 35 U.S.C. 154(b) by 102 days.

(21) Appl. No.: 15/901,604

(22) Filed: Feb. 21, 2018

(65) Prior Publication Data

US 2018/0179757 A1 Jun. 28, 2018

Related U.S. Application Data

(63) Continuation of application No. 14/428,203, filed as application No. PCT/EP2012/068237 on Sep. 17, 2012, now Pat. No. 9,938,721.

(51) Int. Cl.
*E04C 5/07* (2006.01)
*E04C 5/12* (2006.01)
(Continued)

(52) U.S. Cl.
CPC ..... *E04C 5/127* (2013.01); *E04B 1/16* (2013.01); *E04B 5/32* (2013.01); *E04C 2/06* (2013.01);
(Continued)

(58) Field of Classification Search
CPC ... E04C 5/01; E04C 5/012; E04C 5/07; E04C 5/073; E04C 5/08; E04C 5/085;
(Continued)

(56) References Cited

U.S. PATENT DOCUMENTS 2,971,237 A 2/1961 Graham
3,036,356 A * 5/1962 Greulich ..... E04B 5/43 264/228
(Continued)

FOREIGN PATENT DOCUMENTS

AT 390027 B 3/1990
CN 1873103 A 12/2006
(Continued)

OTHER PUBLICATIONS

International Search Report for PCT/EP2012/068237, dated Jun. 21, 2013.
(Continued)

*Primary Examiner* — Jessica L Laux
(74) *Attorney, Agent, or Firm* — Notaro, Michalos & Zaccaria P.C.

(57) ABSTRACT

The present invention concerns a reinforcing element for producing concrete components, a concrete component and corresponding production methods. The reinforcing element comprises a plurality of fibers and a plurality of holding elements which are connected to each other by the fibers so that the fibers can be stressed in their longitudinal direction by means of the holding elements. The fibers are fixed to the holding elements such that the fibers in the stressed state enter the holding elements in a substantially linear manner. This enables both a high degree of pretension and an efficient, reliable and thus cost-effective production of the concrete components.

16 Claims, 3 Drawing Sheets

(51) Int. Cl.

| | |
|---|---|
| ***E04C 5/08*** | (2006.01) |
| ***E04B 1/16*** | (2006.01) |
| ***E04B 5/32*** | (2006.01) |
| ***E04C 2/06*** | (2006.01) |

(52) U.S. Cl.
CPC ..... *E04C 5/07* (2013.01); *E04C 5/073* (2013.01); *E04C 5/085* (2013.01); *E04B 2103/02* (2013.01)

(58) Field of Classification Search
CPC ... E04C 5/127; E04C 2/06; E04B 5/32; E04B 2103/02; E04B 1/16
See application file for complete search history.

(56) References Cited

U.S. PATENT DOCUMENTS

| | | | | |
|---|---|---|---|---|
| 3,882,651 | A * | 5/1975 | Gilchrist | A01K 1/0151 52/223.6 |
| 4,205,926 | A | 6/1980 | Carlson | |
| 4,367,568 | A * | 1/1983 | Weiser | E04C 5/122 24/122.6 |
| 4,648,224 | A * | 3/1987 | Kitta | E04C 5/07 428/372 |
| 4,671,034 | A * | 6/1987 | Rehm | E04C 5/12 52/223.13 |
| 4,819,393 | A * | 4/1989 | Augoyard | E04C 5/122 52/223.13 |
| 4,932,178 | A | 6/1990 | Mozingo | |
| 5,025,605 | A | 6/1991 | Sekijima et al. | |
| 5,072,558 | A * | 12/1991 | Sorkin | B29C 45/14 52/223.13 |
| 5,440,845 | A * | 8/1995 | Tadros | E04C 2/044 52/309.12 |
| 5,617,685 | A * | 4/1997 | Meier | E04C 3/20 52/223.13 |
| 6,067,757 | A | 5/2000 | Olson et al. | |
| 6,487,757 | B1 * | 12/2002 | Stabler | E01D 19/14 24/115 M |
| 6,761,002 | B1 * | 7/2004 | Sorkin | E04C 5/12 403/374.1 |
| 7,124,547 | B2 | 10/2006 | Bravinski | |
| 8,036,356 | B1 * | 10/2011 | Ghosh | H04M 1/575 379/142.1 |
| 8,312,683 | B2 | 11/2012 | Tadros et al. | |
| 8,555,584 | B2 | 10/2013 | Ciuperca | |
| 8,613,172 | B2 | 12/2013 | Olson et al. | |
| 2002/0059768 | A1 | 5/2002 | Blount | |
| 2002/0110680 | A1 | 8/2002 | Bank et al. | |
| 2007/0175583 | A1 * | 8/2007 | Mosallam | B29C 70/088 156/307.1 |
| 2010/0132282 | A1 | 6/2010 | Voss | |
| 2016/0069080 | A1 | 3/2016 | Palermo et al. | |

FOREIGN PATENT DOCUMENTS

| | | | |
|---|---|---|---|
| CN | 101285333 | A | 10/2008 |
| CN | 101463638 | A | 6/2009 |
| CN | 201486017 | U | 5/2010 |
| CN | 101851985 | A | 10/2010 |
| CN | 202000558 | U | 10/2011 |
| CN | 102242505 | A | 11/2011 |
| DE | 2759161 | A1 | 7/1979 |
| DE | 102008011517 | A1 | 9/2009 |
| EP | 0628675 | A1 | 12/1994 |
| JP | 272905 | A | 3/1990 |
| JP | 06-040009 | U | 5/1994 |
| JP | 7015937 | Y | 4/1995 |
| JP | 2001262708 | A | 9/2001 |
| KR | 10-2010-0107100 | A | 3/2009 |
| RU | 2455436 | C1 | 7/2012 |

OTHER PUBLICATIONS

International Preliminary Report on Patentability and Written Opinion for PCT/EP2012/068237, dated Mar. 17, 2015.

* cited by examiner

REINFORCING ELEMENT FOR PRODUCING PRESTRESSED CONCRETE COMPONENTS, CONCRETE COMPONENT AND PRODUCTION METHODS

CROSS REFERENCE TO RELATED APPLICATIONS

This is a continuation of application Ser. No. 14/428,203, filed Jun. 5, 2015, which is a 371 application of international application PCT/EP2012/068237, filed Sep. 17, 2012, which are both incorporated herein by reference and which priority claim is repeated here.

FIELD AND BACKGROUND OF THE INVENTION

The present invention concerns a reinforcing element for producing prestressed concrete components. Further, the invention concerns a prestressed concrete component and a production method for the reinforcing element and the prestressed concrete component.

Prestressed concrete slabs are known from prior art. US 2002/0059768 A1, for instance, discloses a method for producing a prestressed concrete slab by means of stressed wire ropes. To generate the tension, the wire ropes are wound around mutual oppositely located bolts and then put under tensile stress by moving the bolts in opposite direction. This leads to a pretension that is approximately 70% of the breaking stress of the wire ropes.

SUMMARY OF THE INVENTION

The objective of the present invention is to provide an improved reinforcing element for producing prestressed concrete components, an improved concrete component and improved production methods for the reinforcing element and the prestressed concrete component.

The objective is reached by a reinforcing element with the features of claim 1 as well as a concrete component and production methods according to the related claims.

Further embodiments according to the invention are indicated in the further claims.

Further, the present invention concerns a reinforcing element for producing prestressed concrete components, the reinforcing element comprising a plurality of fibers and several holding elements, which are connected to each other by the fibers so that the fibers can be prestressed in their longitudinal direction by means of the holding elements. The fibers are fixed to the holding elements such that the fibers enter the holding elements in a substantially linear manner. Thus, both a high pretension and an efficient, reliable and, therefore, a cost-effective production of the concrete components is achieved.

The term "fiber" comprises both a single or several elongated and flexible reinforcing elements for concrete components, for instance, a single filament—also called single filament or monofilament—or a bundle of filaments—also called multifilament, multifil yarn, yarn or—in case of stretched filaments—called roving. In particular, the term fiber also comprises a single wire or several wires. Further, the fibers can also be coated individually or together, and/or the fiber bundle can be wrapped or twisted.

According to an example, the net cross-sectional area of the fibers (i.e., without resin impregnation) is smaller ca. 5 $mm^2$ and lies in particular in a range between ca. 0.1 $mm^2$ and ca. 1 $mm^2$. According to another example, the tensile strain characteristic of the fibers is bigger than ca. 1%. According to a further example, the tensile strength of the fibers related to their net cross-sectional area is bigger than ca. 1000 $N/mm^2$, in particular bigger than ca. 1800 $N/mm^2$.

When producing a prestressed concrete component, for instance, first of all the reinforcing elements according to the invention are installed in a mold and then the fibers are stressed by means of pulling apart the appropriate holding elements. Afterwards, the concrete component is poured, wherein the parts of the fibers located in the interior of the mold are set in concrete. After hardening of the concrete, the previously to the fibers applied tension is released, wherein the tension of the parts of fibers encased in concrete is preserved, since the fiber parts encased in concrete are connected frictionally with the concrete and practically no relative displacement between the said fiber parts and the concrete occurs. The frictional connection is based—inter alia—on the wedging of the fibers in their concrete casing (Hoyer effect). The stressless parts of the fibers protruding from the concrete component can be separated and removed together with the holding elements. The pretension of the prestressed concrete component is thus caused by the tension of the fibers encased in concrete.

The connection of fibers and concrete can be strengthened by various means, for instance, by an increased surface roughness of the fibers. According to an example, the said connection is formed such that the total dimensional tensile force can be transmitted by the mechanical shear connection after 200 mm, in particular after 100 mm, further in particular after 70 mm, of embedment (i.e., length of the fibers set in concrete).

The fibers of the reinforcing element according to the invention can be made from a plurality of different materials, in particular of non-corrosive material and further in particular from alkali-resistant material. The said material, for instance, is a polymer like carbon but also glass, steel or natural fiber.

For instance, the fibers are made from carbon. Carbon fibers have the advantage that they are very resistant, that means that even for decades no significant losses of stability are detectable. Moreover, carbon fibers are corrosion-resistant, in particular they do not corrode on the surface of the concrete components and are practically invisible. Consequently, carbon fibers can often be left on surfaces of concrete components. But they can also be removed with ease, for instance, by breaking off or simple stripping off.

The fixation of the fibers "in" the holding elements comprises various means of fixation, in particular also the fixation of the fibers "to" or "on" the holding elements, for instance, a laminating of the fibers without further covering.

Surprisingly, by the solution according to the invention both a high pretension of the concrete components and an efficient, reliable and easy handling of the reinforcing elements is achieved. Thus, the concrete components can be produced especially cost-effective. In particular, the following is achieved:

Transverse stresses of the fibers are substantially avoided by entering the fibers in relation to their longitudinal direction in a substantially linear manner, meaning the uniform continuation of the fibers, into the holding elements. Such transverse stresses cause often fiber breaks and occur, for instance, at points of ascents, congestions or small curve radiuses that means typically at plug baffles, deflection pulleys or guide bolts. Thanks to the fixation of the fibers according to the invention with the good force transmission of the acting forces to the holding element, a high tensile force and thus a high pretension of the concrete components can be achieved without an increase of risk of breakage. This is especially advantageous for carbon fibers, in particular for impregnated carbon fibers, since they are exceedingly fragile in regard to transverse stresses.

According to an example, the fibers, in particular the carbon fibers, can be stressed with a tension of ca. 50% to ca. 95% of the breaking stress of the fibers. According to a further example, the fibers can be stressed with at least ca. 80%, in particular at least ca. 90%, of the breaking stress of the fibers. A cost-effective production of very stable, large and thin concrete components is achieved. A high pretension of the concrete component is especially advantageous for carbon fibers, since carbon fibers show a different expansion characteristic than concrete.

Thanks to the reinforcing elements according to the invention, large and thin concrete components can be produced, which do practically not deflect under load. According to an example, the thickness of a concrete component to be produced lies in the range of ca. 10 mm to 60 mm, in particular of ca. 15 mm to 40 mm. According to another example, the extension related to the area of the concrete component is at least ca. 10 m×5 m, in particular at least ca. 10 m×10 m, further in particular at least ca. 15 m×15 m. According to a further example, the length of the concrete component is at least ca. 6 m, further in particular at least ca. 12 m.

Further, the reinforcing elements can be produced in a first place as intermediate products, where required packaged in appropriate transport casks and transported to another place for producing the concrete components. At the other place, for instance, at a concrete manufacturing plant, then the delivered reinforcing elements are directly available as intermediate components.

Further, a robust and space-saving and thus a well transportable unit is achieved by the connection according to the invention of the fibers with the holding elements.

According to an embodiment of the present invention, the fibers are individual fibers and/or comprise one or more rovings, in particular carbon rovings. The production of especially stable and lightweight concrete components is achieved. Individual fibers are understood to be single, not directly connected fibers. In contrast to that, a continuous fiber arrangement has to be seen, whereby the parts of the fiber arrangement that see-saw are connected by loops.

The term "roving" is understood to be a bundle of stretched filaments. Such a roving, also called stretched yarn, comprises typically a few thousand filaments, in particular ca. 2,000 to ca. 16,000 filaments. By the roving, the tensile forces acting on the fibers are substantially distributed to a plurality of filaments so that local peak loads are substantially avoided.

Further, the filaments of the roving comprise a small fiber diameter so that a correspondingly large surface-diameter-ratio and thus a good interconnection between the concrete and the filaments is achieved. Further, a good thrust transmission and a good distribution of the tensile stress to the concrete are achieved.

According to an example, the fibers are made from an arrangement of several rovings, which comprises 2 to 10, in particular 2 to 5, individual rovings. Consequently, the said fibers comprise ca. 4,000 to ca. 160,000 filaments.

According to an embodiment of the present invention, the holding elements comprise guiding elements for the fibers, in particular a clamping device and/or a holder for laminating the fibers at the end zone, in particular a fiber-reinforced polymer matrix, further in particular a polyester matrix. By the said guiding elements, a good force transmission is achieved. Moreover, by laminating an especially space-saving and robust unit is achieved. The holding elements can be formed as twin-sided adhesive tape.

According to an embodiment of the present invention, the fibers located in the holding elements form an essentially flat layer and are arranged, in particular substantially parallel and/or substantially uniformly spaced to each other. Thus, the reinforcing element comprises the shape of a trajectory or a harp. The said shape is easy to stack or to roll, where required by usage of insert sheets for separating the particular fibers. Therefore, reinforcing elements are well transportable.

Such a harp-shaped reinforcing element has the advantage over a grid that no knottings appear and thus very high tensile stress can be achieved. Moreover, complicated production steps, like weaving or braising, omit and there is high flexibility in regard to the width of the trajectories, since no machines for producing a grid are required. Therefore, so called "endless products" both in length and width can be produced in a simple manner.

According to an embodiment of the present invention, the reinforcing element comprises additional spacer, which mutually connect the fibers, for instance, in the form of transverse threads and/or of a fabric so that there is also a space between the individual fibers in case of a not prestressed or only partially prestressed reinforcing element. An entangling of the un-prestressed fibers is substantially or completely prevented. Thus, the said spacer serves as fit-up aid and/or transport aid. Encased in concrete, the spacers bear practically no tensile stress.

According to an embodiment of the present invention, the reinforcing distance is ca. 5 mm to ca. 40 mm, in particular ca. 8 mm to 25 mm, and/or in each of the holding element at least 10, in particular 40, fibers are fixed. For instance, the reinforcing distance, i.e. the distance between two neighboring fibers, is smaller or equal to twice the thickness of the concrete component.

According to an embodiment of the present invention, the fibers are impregnated with an alkali-resistant polymer, in particular with a resin, further in particular with a vinyl ester resin. A higher tensile strength of the fibers is achieved.

According to an embodiment of the present invention, the fibers are coated with a granular material, in particular with sand. An improvement of the interconnection between fibers and concrete and thus a higher stability of the pretension in the concrete component is achieved.

According to an embodiment of the present invention, the fibers are fixed to the holding element such that the fibers in stressed state continue in a substantially linear manner into the holding elements, in particular for a distance of at least ca. 5 mm, further particular of at least ca. 10 mm. A good force transmission between the fibers and the holding elements is achieved.

According to an embodiment of the present invention, the holding elements comprise a, in particular transverse to the direction of the fibers running, means for force distribution, in particular a curvature and/or a profile. A good distribution of the acting forces and thus a high tensile force and/or a small load for the fibers during the stressing is achieved. Moreover, a shortening of the embedment is achieved in doing so, i.e. a shortening of the required length for the reliable fixation of the fibers to the holding elements.

According to an example, the curvature of the holding element is formed such that the curved running fibers each are substantially parallel, in particular vertical to the layer of the fibers, defining a plane. For an arrangement of the fibers in horizontal position, for instance, their fiber ends are vertical curved upwards or downwards.

In particular by the profile, a good frictional connection between the holding element and the clamping device is achieved. Thus, the pressure on the holding element and/or on the fibers can be reduced. According to an example, the profile is arranged on at least one of those surfaces of the holding element, which are designated for the fixation of the holding element in a clamping device. According to another example, the profile is wave-like or tooth-like, in particular saw tooth-like.

According to an embodiment of the reinforcing element according to the invention, the width of the reinforcing element is larger than 0.4 m, in particular than 0.8 m, and/or the length of the reinforcing element is larger than 4 m, in particular larger than 12 m. An efficient production of large concrete components is achieved. For instance, a concrete slab measuring 20 m×20 m can be produced in one working cycle.

Further, the present invention concerns a method for producing a reinforcing element for prestressed concrete components, wherein the method comprises the steps:

providing of prestressed fibers by collectively pulling out a plurality of mutually spaced fibers; and fixing a holding element to the prestressed fibers, in particular by clamping and/or laminating, to fix the fibers' mutual position, in particular with respect to distance and/or direction.

A substantially parallel processing of the fibers and thus a very efficient production of the reinforcing element and an advantageous arrangement of the fibers is achieved, in particular also with regard to the further use of the reinforcing element, namely for the tensioning of the fibers before and during the setting in concrete.

According to an example, the holding element is cut through after connecting with the fibers, in particular centric, so that both generated segments form in turn two holding elements for two successively produced reinforcing elements. The first segment forms the end of a first reinforcing element and the second segment forms the beginning of the successional reinforcing element.

According to another example, the holding element is formed as double holding element, wherein between the two parts an open intermediate space is located, in which the fibers are exposed. The said cutting through of the holding elements can be performed by simple cutting of the fibers in the said intermediate space, for instance, by breaking. An efficient separation for the production, in particular for the production in series, of the reinforcing elements is achieved.

According to an embodiment of the method for producing the reinforcing element according to the invention, the fixing of the holding element is carried out during the collective pulling out of the fibers, in particular by moving the holding elements synchronously to the movement of the fibers. A very efficient production is achieved, in particular for the production in series of the reinforcing elements.

According to an embodiment of the method for producing the reinforcing element according to the invention, the fixation of the holding element is accomplished by fixing an upper part and a lower part of the holding element from opposite parts of the fibers, in particular by joining glass fiber mats.

According to a further embodiment of the method for producing the reinforcing element according to the invention, the arrangement of the fibers is accomplished by loading the fibers on a first part of the holding element and fixing the fibers by adding a second part of the holding element and by pushing together the two said parts. The fibers of the holding elements are tightly enclosed so that an especially strong and robust fixation is achieved.

Further, the present invention concerns a prestressed concrete component, in particular a concrete slab, which is produced by use of at least one reinforcing element according to the invention, wherein the pretension of the concrete component is at least 80%, in particular at least 90%, of the breaking stress of the fibers.

According to an example, the said concrete component is produced by use of a plurality of, in particular in groups arranged, reinforcing elements according to the invention. By the arrangement in groups, an improved adjustment to the states of the concrete component is achieved. An arrangement in groups can be achieved by one or more horizontal and/or vertical distances or by angular, in particular rectangular, arrangements.

According to an example, the prestressing of the fibers is accomplished by stressing in sections, in particular individually for each of the used reinforcing elements. The pretension can be adjusted flexible to specific requirements.

According to an example, the reinforcing distance, i.e. the distance between two neighboring fibers, is smaller or equal to twice the thickness of the concrete component, in particular smaller or equal to twice the thickness of the slab.

Further, the present invention concerns a method for producing a prestressed concrete component, wherein the method comprises the steps:

providing at least one reinforcing element according to the invention;

stressing the fibers of the reinforcing element by pulling apart the appropriate holding elements; and concreting of the concrete component by, at least partially, setting in concrete the stressed fibers.

Very efficient and easy manageable preparatory works and thus cost-effective production of the concrete component is achieved. In particular extensive and complex laying-work of individual fibers, in particular delicate basketry, is omitted. Thus, the method according to the invention is very well suited for the production methods in a manufacturing site for concrete components.

The method according to the invention is especially suitable for the production of large prestressed concrete components, for instance, for concrete components of ca. 20 m width and ca. 20 m length. In an ensuing working step, the said large prestressed concrete components can be divided into smaller prestressed concrete components, since the pretension of the concrete components always remains during separation. The smaller concrete components can then be cut individually, for instance, by sawing, CNC milling or water jet cutting, to produce, for instance, specially shaped floor plates, stair treads or tables for table tennis. Such a partition can be achieved—as described further down more detailed—by use of separative elements, in particular of a foam.

In a further embodiment of the method for producing the prestressed concrete component according to the invention, the providing of the at least one reinforcing element is accomplished by arranging several reinforcing elements in a layer, in particular by substantially parallel and/or neighboring placing side by side. An efficient setting of large areas is achieved.

In a further embodiment of the method for producing the prestressed concrete component according to the invention, the providing of the at least one reinforcing element is accomplished by arranging the reinforcing elements in at least two layers, wherein the orientation of the reinforcing elements in neighboring layers is arranged in an angle, in particular substantially rectangular. An efficient and flexible setting of a complex reinforcing is achieved. For instance, the providing of the at least one reinforcing element is accomplished by layering several reinforcing elements on top of each other.

In a further embodiment of the method for producing the prestressed concrete component according to the invention, the prestressed concrete component comprises additionally the step of inserting a separative element, in particular of a foam, before concreting the concrete component. An effective partition of the concrete component is achieved. In particular a foam features a very flexible, well applicable and cost-effective partition. As further functionality, the foam features a helping mean for positioning the fibers and/or a fixation of the fibers during the concreting. As separative element a solid material can be applied, for instance, natural rubber or styrofoam.

In a further embodiment of the preceding method for producing the prestressed concrete components, the method comprises additionally the step of separating the concrete component after concreting, in particular by breaking and/or sawing. Since the foam does not contribute noteworthy to the stability, the single partitions of the concrete component are practically held together only by the fibers. Thus, the concrete components can be separated easily, in particular by simple breaking. A partition in well manageable parts is achieved in a comfortable and efficient way. For instance, the said parts can be distributed from a manufacturing site for concrete components to further activity areas and brought into final shape there.

It is explicitly pointed out that each combination of the aforementioned examples and embodiments or combinations of combinations can be subject matter of a further combination. Only combinations that would lead to a contradiction are excluded.

BRIEF DESCRIPTION OF THE DRAWINGS

Further embodiment examples of the present invention are illustrated hereafter by means of figures. It is shown in.

DETAILED DESCRIPTION OF THE PREFERRED EMBODIMENTS

The following embodiments are examples and are meant to limit the invention in no way.

Figure 1:
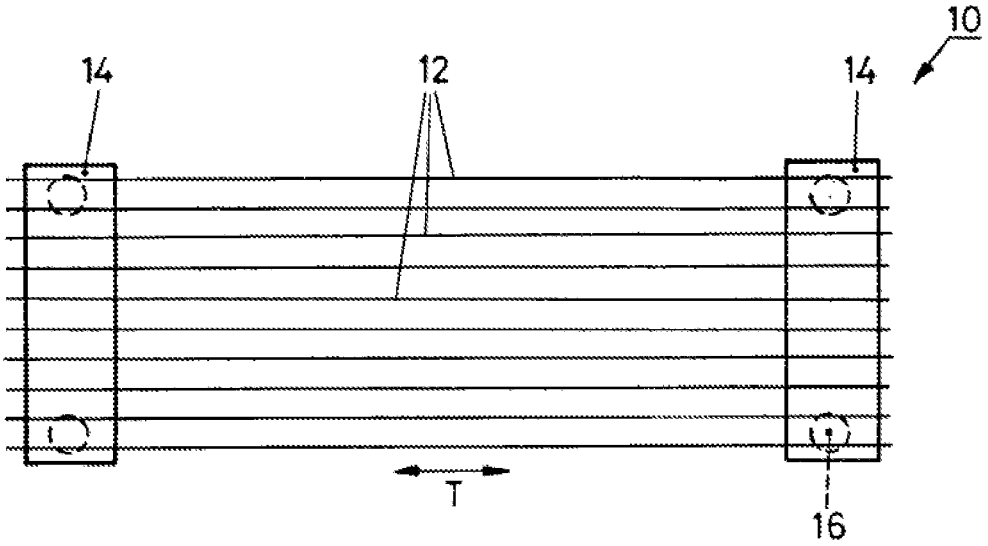
FIG. 1 a simplified schematic illustration of an embodiment example of the reinforcing element 10 according to the invention with carbon fibers 12, which can be prestressed using two holders 14.

FIG. 1 shows a simplified schematic illustration of an embodiment example of the reinforcing element 10 according to the invention in stretched state. Such a reinforcing element 10 serves for the production of prestressed concrete components.

The reinforcing element 10 comprises ten individual fibers, which are formed as carbon fibers 12 (only partially labeled) in this example and two holding elements in shape of two holders 14. The holders 14 are arranged in distance to each other and connected to each other by the ten carbon fibers 12. The carbon fibers 12 can be stressed by pulling apart the holders 14 in their longitudinal direction T.

According to the invention, the carbon fibers 12 are fixed in the holders 14 such that the stretched carbon fibers 12 enter the holders 14 in a linear manner. Further, the carbon fibers 12 form an essentially flat layer, wherein that layer the carbon fibers 12 are arranged substantially parallel and substantially uniformly spaced to each other. The reinforcing element 10 has the shape of a harp. According to this example, the reinforcing distance, i.e. the distance between the parallelly arranged carbon fibers 12, is ca. 10 mm and thus the width of the reinforcing element 10 is ca. 10 cm.

Each of the carbon fibers 12 comprises a carbon roving each, i.e. a bundle of a few thousand stretched, arranged side by side and essentially equally oriented filaments (ca. 2,000 to ca. 16,000 filaments). The said filaments and thus the carbon fibers as well, are impregnated with an alkali-resistant resin in the form of vinyl ester resin so that the carbon fibers 12 form a compact unit, similar to a metal wire. The impregnating can be carried out, for instance, by means of a dipping bath, through which the roving is pulled for producing the carbon fibers 12.

Moreover, the carbon fibers 12 are coated with sand so that an improved connection of the fibers with the concrete is achieved. According to this example, with an embedment of 100 mm, the full dimensional tensile force can be transmitted by the mechanical shear connection.

Further, the holders 14 comprise two openings 16 each (drawn as dashed line) by means of which the holders 14 can be sited on a clamping device (not shown). With the clamping device, the carbon fibers 12 can precisely be adjusted during the production of the concrete components and can be stressed, in particular without horizontal and/or vertical tilting. According to another example, the holder 14 comprises a hole or a plurality of holes, in particular more than two holes, for positioning the holder 14.

According to an example, for producing the holder 14 cost-effective materials are used. An exemplary material composition and the appropriate production of the holder 14 is illustrated by means of FIG. 2. Other materials can be used as well, since the holder 14 is not a part of the concrete component to be produced and is normally separated and removed after concreting.

Figure 2:
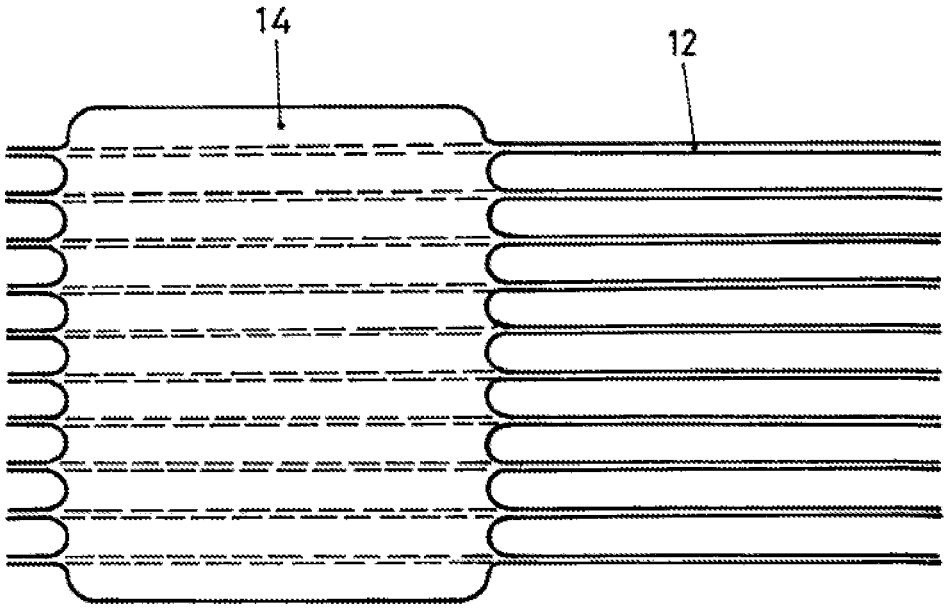
FIG. 2 a simplified schematic detail view of a holder 14 according to FIG. 1.

FIG. 2 shows a simplified schematic detail view of a holder 14 according to FIG. 1.

The holder 14, also referred to as patch, comprises a fiber-reinforced polymer matrix in form of a polyester matrix with therein enclosed fibers in form of two glass fiber mats. The said polyester matrix encloses the stretched carbon fibers 12 at their end zones. For instance, the size of the said polyester matrix is ca. 10 cm×10 cm and the total thickness is ca. 2 mm. According to another example, the length expansion of the polymer matrix in direction of the carbon fibers 12 is between ca. 10 cm and ca. 20 cm. The fiber mats form an upper and lower layer, wherein the stretched carbon fibers 12 are located between these layers and fixed therein by lamination with polyester. Therefore, the polyester matrix forms a straight-lined guiding element (indicated by dashed lines) for the carbon fibers 12, wherein the carbon fibers 12 inside the polyester matrix, i.e. inside the holder 14, substantially continue in a linear manner. By means of the holder 14, the carbon fibers 12 are fixed in their mutual position, namely in a flat layer, substantially parallel and uniformly spaced to each other.

The ends of the carbon fibers 12 protrude at the outlet side of the holder 14 beyond the holder 14 at some extend. But also, the fibers 12 can end within the holder 14 or be flush with the ends on the surface of the holder 14, for instance, when the holder 14 is separated from a larger unit.

For instance, such a holder 14 is produced by the following steps:

- providing a plurality of adjacent and mutually spaced carbon rovings by substantially simultaneously stripping of the carbon rovings from an appropriate number of supply rolls;
- impregnating of the carbon rovings by means of passing the carbon rovings through a vinyl ester resin dipping bath so that the carbon rovings form compact carbon fibers 12;
- collective pulling out the carbon fibers 12, where required by means of a previously placed holder 14 so that the carbon fibers 12 are stressed;
- applying two glass fiber mats saturated with polyester to the stressed carbon fibers 12, one from below and the other from above;
- joining the two glass fiber mats, where required by adding an additional quantity of the polyester so that the saturated glass fiber mats and the polyester enclose the stressed carbon fibers 12; and
- hardening of the polyester so that the carbon fibers 12 are fixed frictionally in the holder 14.

By means of this laminating, the holder 14 forms together with the carbon fibers 12 a compact and robust unit.

Figure 3:
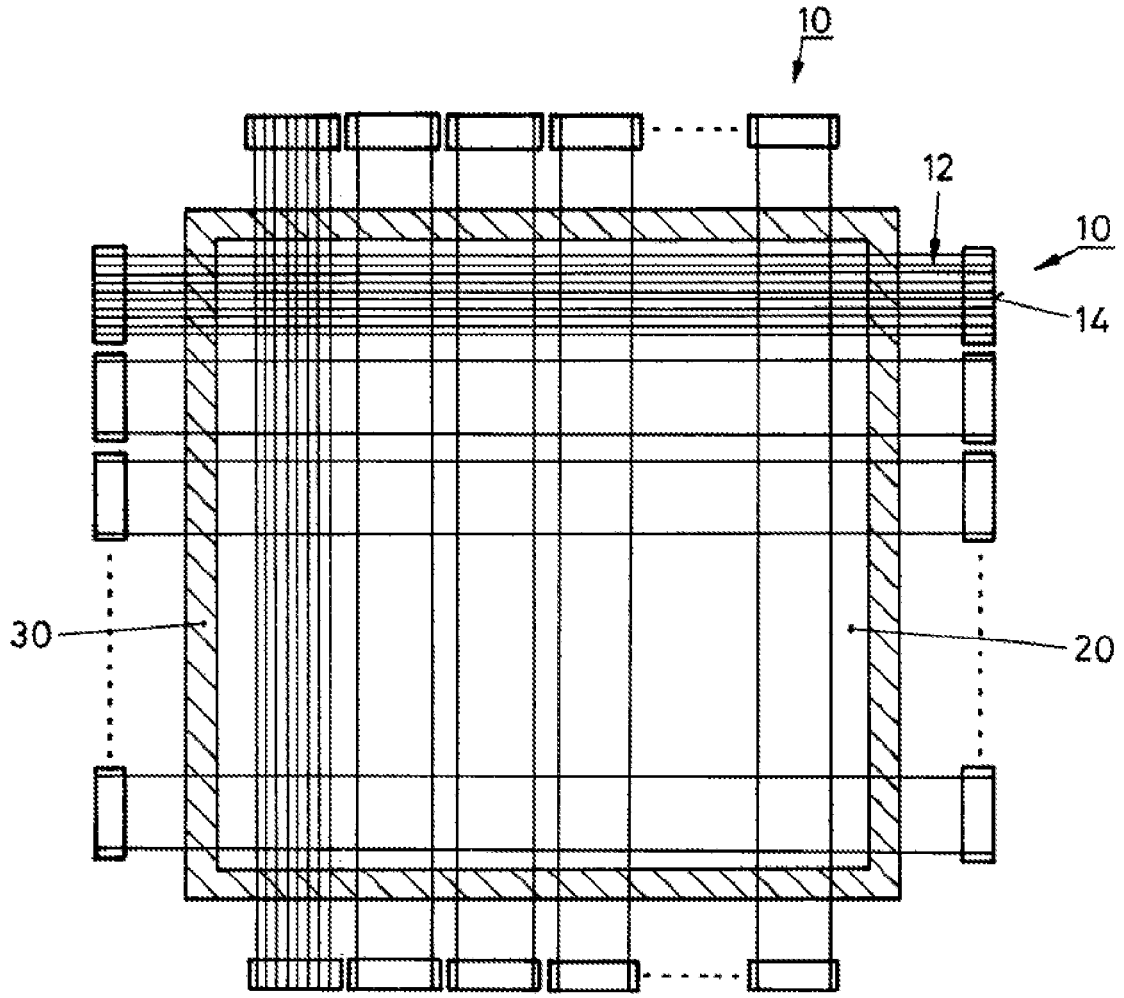
FIG. 3 a simplified schematic illustration of an intermediate state during the production of a prestressed concrete slab 20 using a plurality of reinforcing elements 10 according to FIG. 1.

FIG. 3 shows a simplified and schematic illustration of an intermediate state for the production of a prestressed concrete slab 20, for instance, at a precast concrete plant for concrete slabs. The intermediate state means an arrangement after conclusion of the preparatory work, however, even before the concreting of the concrete slab 20.

The arrangement comprises a shuttering table (not shown), a hollow frame 30 arranged thereon and a plurality of identical reinforcing elements 10 according to the invention (partially only indicated schematically). The hollow frame 30 forms together with the surface of the shuttering table a mold for the concrete, also called pretension bed.

The reinforcing elements 10 comprise a plurality of carbon fibers 12 each (due to clarity partially only the outer fibers are shown) and two holders 14 and correspond in their set-up substantially to the reinforcing elements 10 according to FIG. 1. According to this example, the length of the carbon fibers is, however, ca. 20 m and the width of the holders 14 is ca. 1 m. The reinforcing distance is equal to the preceding example, i.e. as in FIG. 1 ca. 10 mm, so that ca. 100 carbon fibers 12 are fixed on the holders 14 each.

For the arrangement of the reinforcing elements 10, the holders 14 are pulled apart each so that the carbon fibers 12 are located inside of the hollow frame 30 in stretched state. The carbon fibers 12 are lead through the hollow frame 30 to the outside so that the ends of the carbon fibers 12 and the holders 14 are located outside of the hollow frame 30, for instance, with a distance to the hollow frame 30 of 30 cm. For a two-part hollow frame 30, the passages can also be formed by appropriate interspaces between upper part and lower part of the hollow frame 30. The hollow frame 30 is built of several strips lying upon another so that the carbon fibers 12 can be led through the interspaces of the individual strips. The interspaces can additionally be sealed with sponge rubber and/or brush hair. According to an example, the height of the strips lying upon another is 3 mm, 12 mm and 3 mm.

In the shown arrangement, the first half of the reinforcing elements 10 lays in a first layer, parallel and neighboring side by side and the second half of the reinforcing elements 10 lays in a second layer, also parallel and neighboring side by side, however, perpendicular to the reinforcing elements 10 of the first layer. The reinforcing elements 10 are thus arranged in separated layers, put one on top of another and are oriented in the two neighboring layers perpendicular to each other. The reinforcing elements 10 form thus both a longitudinal armor and a transverse armor, however, without individual braiding of the individual carbon fibers 12.

After arranging the reinforcing elements 10, the holders 14 are pulled apart, for instance, by means of a clamping device, also called pretension facility, or manually by means of a torque wrench (not shown). For instance, a tension of at least ca. 30 kN/m to at least 300 kN/m is created, depending on the load requirements for the concrete slab (dimensioning force).

Subsequent to the described situation, concrete can be poured in the, in such a manner prepared, hollow frame 30 to concrete the concrete slab 20 in a single working step. The parts of the stressed carbon fibers 12, which are located in the hollow frame 30, are enclosed by the concrete and thus encased in concrete. Especially suitable is SCC fine concrete (at least C30/37 according to NORM SIA SN505 262), which can easily flow through the interspaces of the carbon fibers 12. The concrete can also be inserted into the hollow frame 30 by extruding or filling and be uniformly distributed by vibration.

After the hardening of the concrete, the concrete slab 20 can be removed from the hollow frame 30. The carbon fibers 12 encased in concrete form the static reinforcement of the concrete slab 20. The parts of the carbon fibers 12 protruding from the concrete are broken off at the edges of the concrete slab 20 and removed together with the holders 14. According to this example, the produced concrete slab is ca. 6 m×2.5 m large and the reinforcing share of this concrete slab 20 is more than 20 $mm^2$/m width. According to another example, the concrete slab is ca. 7 m×2.3 m large.

Figure 4:
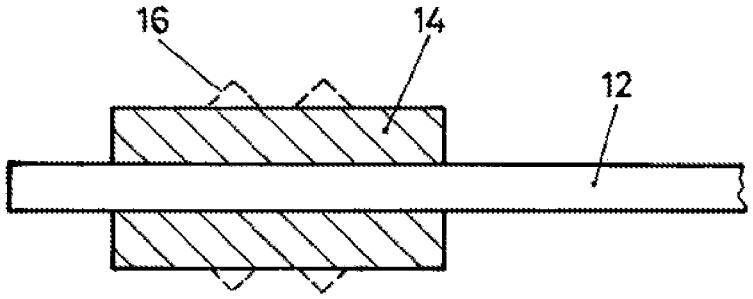
FIG. 4 a simplified schematic side view of the holder 14 according to FIG. 2.

FIG. 4 shows a simplified and schematic side view of a holder 14 according to FIG. 2. The carbon fibers 12 enter the holder 14 in a linear manner. Further, the carbon fibers 12 continue in a linear manner in the inside of the holder 14 so that the holder 14 forms a straight-lined guidance for the carbon fibers 12. According to this example, the longitudinal extension of the holder 14 in direction of the carbon fibers 12 is ca. 3 cm.

The holder 14 can additionally comprise a profile 16 (drawn as dashed line). According to this example, a teeth-shaped profile 16 is located on a first (upper) area and on the thereto oppositely located (lower) area of the holder 14. The said areas are intended for the fixing of the holder 14 in a clamping device (not shown), for instance, by clamping. By means of the teeth-shaped profile 16, a frictional connection between the holder 14 and the clamping device in form of a toothing is achieved.

Figure 5:
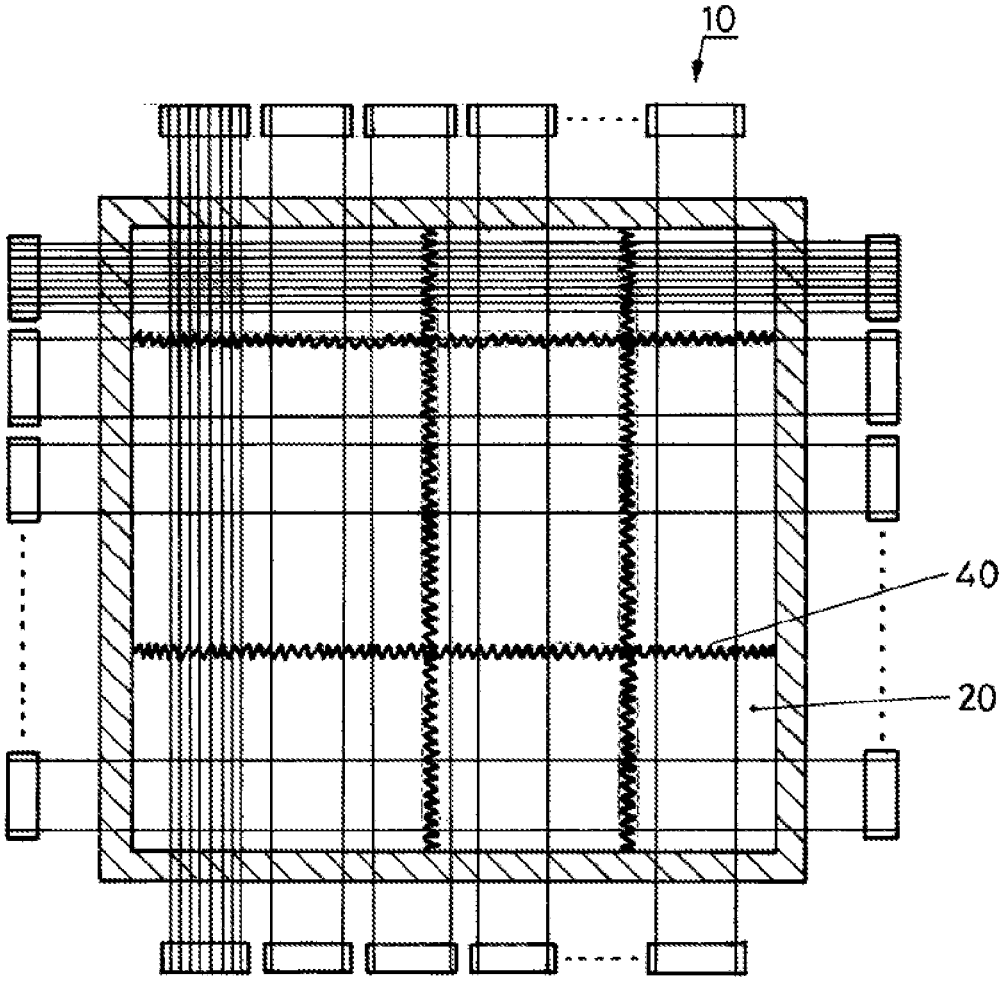
FIG. 5 a simplified schematic illustration according to FIG. 3, however, additionally with a building foam 40 for partition of the concrete slab 20 and fixation of the carbon fibers 12.

FIG. 5 shows an illustration according to FIG. 3, for the reinforcing elements 10, however, a partition is additionally carried out by foaming a building foam 40 (indicated as wavy line) as separative element both on the bottom of the hollow mold and underneath and above the carbon fibers 12.

By means of the said partition no or only a negligible quantity of the poured concrete can enter into that space that is filled up by the partition. Thus, only the partial spaces of the hollow frame with the fiber parts located therein are concreted. In addition, the building foam 40 provides a fixation of the fibers during concreting.

After the hardening of the concrete, the concrete slab 20 can be broken into individual raw slabs along the building foam partitions. The said raw slabs can be further processed, for instance, by bringing the raw slabs into the desired shape by means of a buzz saw.

According to this example, the produced concrete slab is ca. 20 m×20 m large and its thickness is ca. 20 mm. From separating the concrete slab 20 according to the partition by the building foam 40, 24 smaller slabs having a size of ca. 5 m×ca. 3 m do result. Out of the said smaller slabs, for instance, 3 table tennis tables can be sawed.

Figure 6:
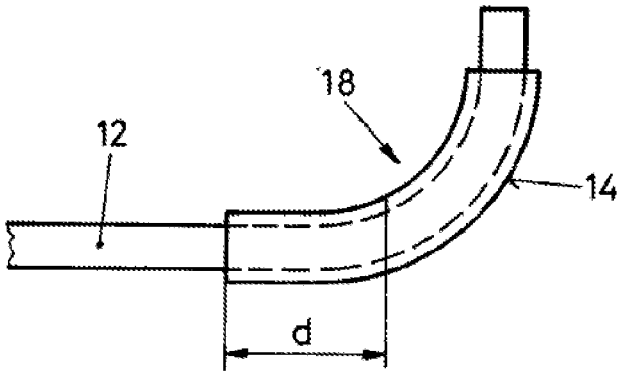
FIG. 6 a simplified schematic said view of the holder 14 according to FIG. 2, wherein the said holder, however, comprises a curvature.

FIG. 6 shows a simplified schematic side view of a holder 14 according to FIG. 2, wherein the said holder 14, however, comprises a means for the force distribution in form of a curvature 18. The carbon fibers 12 enter the holder 14 in a linear manner and continue inside the holder, according to the curvature 18 of the holder 14, with a curvature as well. The carbon fibers 12 are fixed in the entry zone of the holder 14 such that the carbon fibers 12 continue in a substantially linear manner for a distance d of 10 mm in the holder 14. By means of the said shape, both a good introduction of the fibers into the holder 14 and a uniform distribution of the forces to be absorbed is achieved.

The invention claimed is:

1. A reinforcing element for producing prestressed concrete components, the reinforcing element comprising:

a plurality of fibers and several holding elements, which are connected to each other by the plurality of fibers so that the plurality of fibers is capable of being stressed in longitudinal direction of the plurality of fibers by means of the holding elements, wherein the fibers form one essentially flat layer and the net cross-sectional area of the fibers is smaller 5 $mm^2$, wherein the fibers are coated with a granular material, wherein the holding elements comprise guiding elements for the plurality of fibers, and wherein the guiding elements comprise at least one polymer matrix for laminating the plurality of fibers.

2. The reinforcing element according to claim 1, wherein the reinforcing element comprises the shape of a harp such that no knots appear.

3. The reinforcing element according to claim 1, wherein the tensile strength of the fibers related to the net cross-sectional area of the fibers is greater than about 1000 $N/mm^2$.

4. The reinforcing element according to claim 1, wherein the plurality of fibers is fixed to the holding elements by laminating or clamping and laminating.

5. The reinforcing element according to claim 1, wherein the plurality of fibers is made from at least a material selected from the group consisting of carbon, glass, steel and natural fiber.

6. The reinforcing element according to claim 1, wherein the reinforcing distance is about 5 mm to about 40 mm.

7. The reinforcing element according to claim 1, wherein the plurality of the fibers is fixed to the holding elements such that the plurality of the fibers in a stressed state at least enter or continue in a substantially linear manner into the holding elements.

8. The reinforcing element according to claim 1, wherein the width of the reinforcing element is larger than 0.4 m and the length of the reinforcing element is larger than 4 m.

9. The reinforcing element according to claim 1, wherein the reinforcing element is harp-shaped.

10. The reinforcing element according to claim 1, wherein the fibers are impregnated with an alkali-resistant polymer.

11. The reinforcing element according to claim 1, wherein the fibers are coated with sand.

12. A method for producing a prestressed concrete component, comprising in the following order the steps of:

providing at least one reinforcing element according to claim 1;

stressing the plurality of fibers of the reinforcing element by pulling apart the holding elements to create a stressed state; and concreting of the concrete component by, at least partially, pouring in concrete the plurality of fibers.

13. A method according to claim 12, wherein the step of stressing the plurality of fibers of the reinforcing element by pulling apart the holding elements to create a stressed state is accomplished by applying a tension of at least about 30 kN/m.

14. A method according to claim 12, wherein the step of providing at least one reinforcing element is accomplished by arranging several of the reinforcing elements in a layer.

15. A method according to claim 12, wherein the step of providing at least one reinforcing element is accomplished by arranging the reinforcing elements in at least two layers, wherein the orientation of the reinforcing elements in neighboring layers is arranged at an angle.

16. The method according to claim 12, wherein the method comprises additionally the step of:

inserting a separation element before concreting the concrete component.

* * * * *